US008274005B2

(12) United States Patent
Chen et al.

(10) Patent No.: US 8,274,005 B2
(45) Date of Patent: Sep. 25, 2012

(54) KEYPAD ASSEMBLY

(75) Inventors: Chao Chen, Waterloo (CA); Chen Xu, TianJin (CN)

(73) Assignee: Research In Motion Limited, Waterloo (CA)

( * ) Notice: Subject to any disclaimer, the term of this patent is extended or adjusted under 35 U.S.C. 154(b) by 352 days.

(21) Appl. No.: 12/713,884

(22) Filed: Feb. 26, 2010

(65) Prior Publication Data

US 2011/0209975 A1 Sep. 1, 2011

(51) Int. Cl.
*H01H 13/06* (2006.01)

(52) U.S. Cl. ..... 200/302.1; 200/516; 200/302.2

(58) Field of Classification Search ..... 200/5 A, 200/406, 516, 517, 296, 302.1–302.3, 310–317, 200/341, 345
See application file for complete search history.

(56) References Cited

U.S. PATENT DOCUMENTS

| | | | | |
|---|---|---|---|---|
| 4,056,701 | A | 11/1977 | Weber | |
| 4,163,125 | A * | 7/1979 | Boulanger | 200/5 A |
| 4,368,369 | A * | 1/1983 | Matsumoto et al. | 200/511 |
| 5,114,790 | A * | 5/1992 | Corbett | 428/408 |
| 5,172,805 | A * | 12/1992 | Gumb | 200/341 |
| 5,834,715 | A * | 11/1998 | Sato et al. | 200/5 A |
| 6,587,332 | B2 | 7/2003 | Herranen et al. | |
| 6,603,086 | B2 | 8/2003 | Kawaguchi et al. | |
| 7,050,292 | B2 * | 5/2006 | Shimura et al. | 361/679.01 |
| 7,064,288 | B2 | 6/2006 | Nam | |
| 7,564,001 | B2 * | 7/2009 | Koizumi | 200/341 |
| 8,071,902 | B2 * | 12/2011 | Ichikawa et al. | 200/341 |
| 2002/0005791 | A1 | 1/2002 | Ono | |
| 2002/0130024 | A1 | 9/2002 | Kawaguchi et al. | |
| 2004/0257206 | A1 | 12/2004 | Kivisto et al. | |
| 2007/0084710 | A1 * | 4/2007 | Koyano et al. | 200/341 |
| 2008/0164133 | A1 | 7/2008 | Hayafune | |
| 2009/0065342 | A1 | 3/2009 | Yoon et al. | |
| 2009/0272639 | A1 | 11/2009 | Mittleman et al. | |
| 2010/0213041 | A1 * | 8/2010 | Chen et al. | 200/314 |

FOREIGN PATENT DOCUMENTS

| | | | |
|---|---|---|---|
| EP | 0444914 | A2 | 9/1991 |
| EP | 1406276 | A1 | 4/2004 |
| WO | 2006073263 | A1 | 1/2006 |
| WO | 2007084078 | A1 | 7/2007 |

OTHER PUBLICATIONS

Extended European Search Report dated Jul. 14, 2010. In corresponding application No. 10154931.9.

* cited by examiner

*Primary Examiner* — Michael Friedhofer
(74) *Attorney, Agent, or Firm* — Fitch, Even, Tabin & Flannery, LLP

(57) ABSTRACT

A keypad assembly is described herein in which the keypad assembly includes a substrate and a plurality of domes positioned on the substrate and configured to translate operator action into a corresponding input for a machine. The keypad assembly also includes a dome overlay positioned over the domes and the substrate in which the dome overlay can create a sealed environment for the substrate and the domes. A light guide that directs light in the keypad assembly and an interlocking component coupled to the light guide can also be part of the keypad assembly. In one arrangement, the interlocking component can selectively compress the dome overlay to assist in the creation of the sealed environment. In another arrangement, the interlocking component can compress the dome overlay by bending the dome overlay at an edge of the substrate.

19 Claims, 6 Drawing Sheets

KEYPAD ASSEMBLY

FIELD OF TECHNOLOGY

The subject matter herein generally relates to keypad assemblies and in particular, to keypad assemblies with multiple switches or domes.

BACKGROUND

In recent years, mobile devices with QWERTY keypads have become popular in the wireless industry. Mobile devices with QWERTY keypads are convenient for operators because the operator can usually enter in text or other symbols without having to cycle through various settings, which is not the case for devices with keypads containing the standard 3 column by 4 row grid. The current trend with mobile devices, however, is to shrink the overall size of the devices. Given the limited amount of available space on a mobile device, it can be difficult to accommodate QWERTY keypads.

Some QWERTY keypads may contain up to thirty-five keys. Each key typically sits over a dome or popple, which is a switch that is positioned on a circuit board and that typically provides tactile feedback to the operator. When a key is pressed, the key contacts the dome and causes it to collapse. When this event occurs, a circuit underneath the dome is completed, and a corresponding event can be executed on the mobile device. Because each key in a QWERTY keypad has a corresponding dome, a mobile device containing this type of keypad may include up to thirty-five domes, as well.

Due to the spatial constraints of mobile devices, some of the domes in a mobile device that includes a QWERTY keypad may be placed close to the edge of the device's circuit board. By positioning the domes near the edges of the circuit board, however, it may be easier for external contaminants, such as dust or water, to enter the mobile device due to the construction of the keypad. Although it is possible to move the domes that are located on the edges of the circuit board slightly towards the center of the board, such a process can cause the domes to be misaligned with the keys on the edges of the keypad. This misalignment can degrade the tactile feedback performance of the mobile device.

BRIEF DESCRIPTION OF THE DRAWINGS

Embodiments of the present application will now be described, by way of example only, with reference to the attached Figures, wherein.

DETAILED DESCRIPTION

Figure 1:
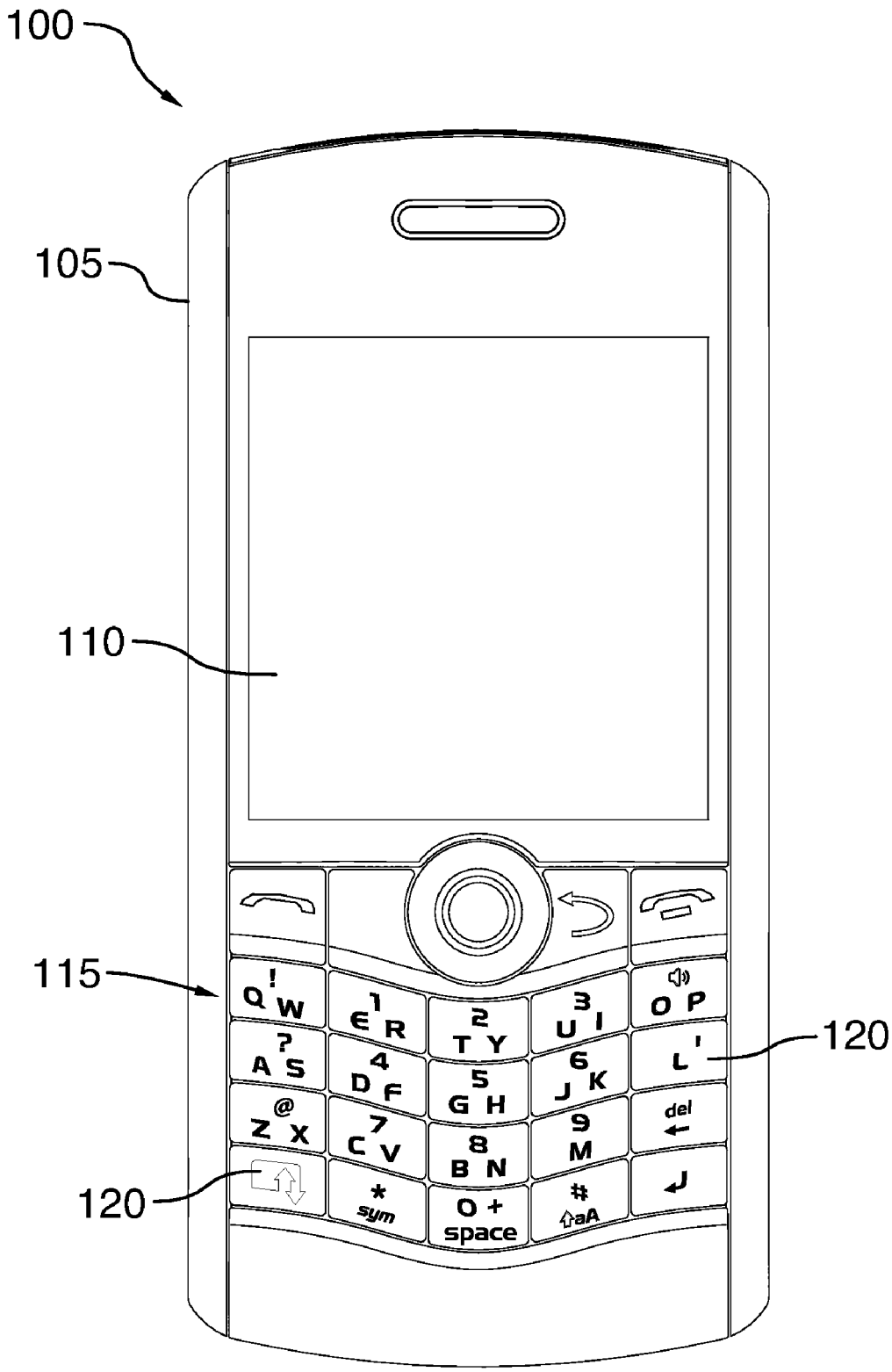
FIG. 1 illustrates an exemplary mobile device.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein.

Several definitions that apply throughout this document will now be presented. The word "coupled" is defined as connected or integrated with, whether directly or indirectly through intervening components and is not necessarily limited to physical connections. The term "mobile device" is defined as any electronic device that is capable of at least accepting information entries or commands from a user and includes its own power source. A "substrate" is defined as a supporting material on which circuitry is positioned, formed or fabricated. A "dome" is defined as a mechanism that at least assists in the translation of an action into a corresponding electrical signal. The term "sealed environment" means a hermetically or substantially hermetically closed space or component. The terms "compress," "compressed" or "compresses" means to make more compact by or as if by the act of pressing. A "beveled surface" is defined as a surface that does not form a right angle with another surface. The term "deformable material" is defined as a material whose shape may change when a force is applied to the material and may substantially return to its original form when the force is removed. The terms "bend" or "bending" means to force a material or component from one form into another form, including (but not limited to) a curved or angular form or direction.

As noted earlier, some keypads designed for mobile devices may include a relatively large number of keys, some as high as thirty-five of them. There is, however, a limited amount of space available for the keypads. As a result, some of the domes for operating the keypad are positioned near the edge of the substrate on which they are positioned, which makes them more susceptible to contamination from the external environment. A keypad assembly that overcomes these disadvantages is presented herein.

In one arrangement, the keypad assembly includes a substrate and a plurality of domes positioned on the substrate and configured to translate operator action into a corresponding input for a machine. The keypad assembly also includes a dome overlay positioned over the domes and the substrate in which the dome overlay can create a sealed environment for the substrate and the domes. A light guide that directs light in the keypad assembly and an interlocking component coupled to the light guide can also be part of the keypad assembly. In one arrangement, the interlocking component can selectively compress the dome overlay to assist in the creation of the sealed environment. In another arrangement, the interlocking component can compress the dome overlay by bending the dome overlay at an edge of the substrate. This configuration can permit domes to be placed near the edge of the substrate, as necessary in many mobile devices, and can also help protect the domes from being contaminated by external contaminants, such as dirt or humidity.

Referring to FIG. 1, an example of a mobile device 100 is shown. In one arrangement, the mobile device 100 can include a housing 105, a display 110 and a keypad 115. The keypad 115 can include a keyfield having a plurality of keys 120 arranged in a keyboard layout. The keys 120 can be alpha-numeric keys, numeric keys or other function keys. It is understood, however, that the keypad 115 can alternatively be a touch keypad (not shown) that can be shown on the display 110 for touch-screen entry. While in the illustrated embodiment the mobile device 100 is a handheld wireless communication device, the mobile device 100 can be any of the following: a personal digital assistant (PDA), a handheld electronic device, a non-handheld wireless communication device, a pager, a cellular phone, a cellular smart-phone, a wireless organizer, a wirelessly enabled notebook computer and the like.

Figure 2:
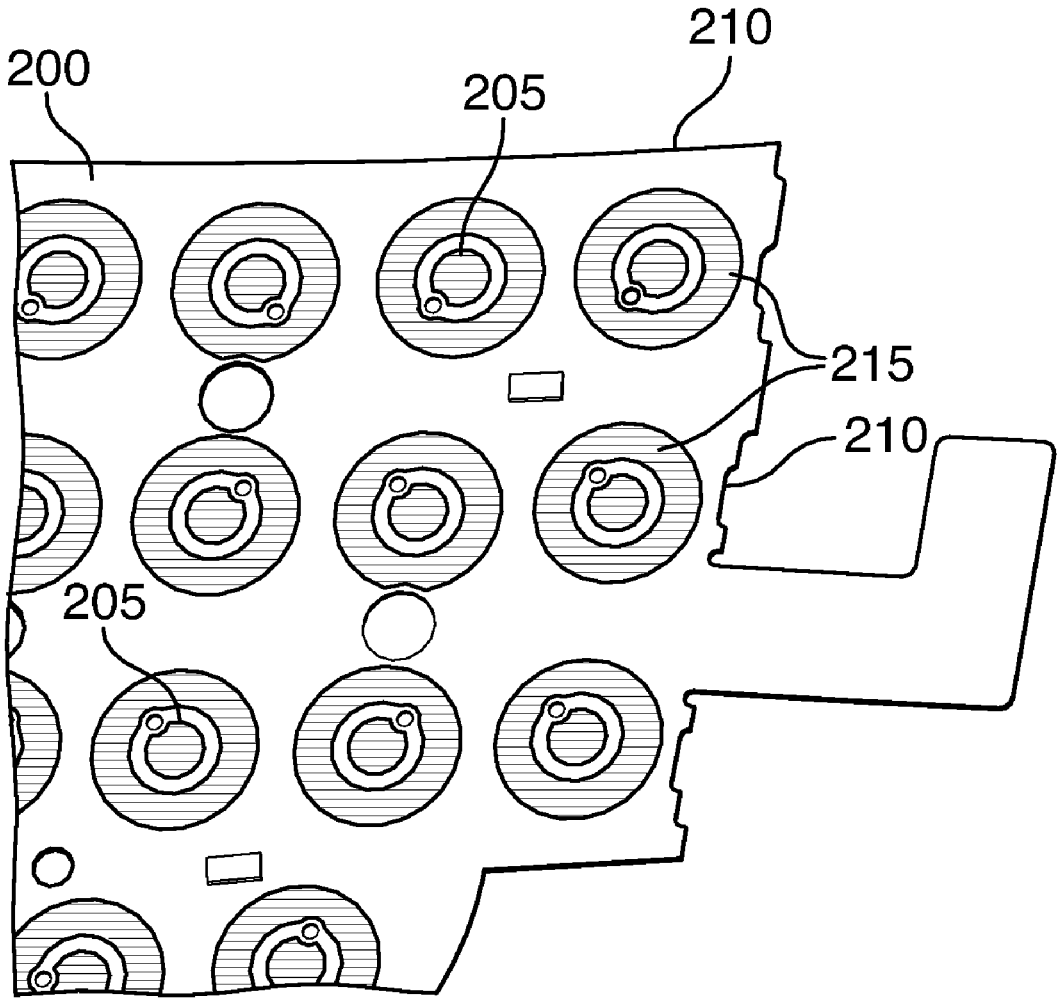
FIG. 2 illustrates an exemplary substrate having a plurality of dome pads positioned on the substrate.

Referring to FIG. 2, a substrate 200 having a plurality of dome pads 205 is shown. Each dome pad 205, along with a dome cover (not shown here), can form part of a dome (also not shown here). In one arrangement, the keypad 115 of FIG. 1 may be positioned over the substrate 200 and the dome pads 205. The domes can be configured to translate operator action into a corresponding input for a machine, such as the mobile device 100. For example, the domes can be compressible and can translate the operator action when the operator presses the keypad 115 in a predetermined area by completing a circuit. In particular, the operator can press a particular key 120, which can cause the dome corresponding to that key 120 to be compressed. Following the compression, the dome can complete a circuit (not shown) defined by the dome pads 205 that can cause a corresponding event to occur in the mobile device 100, such as the selection of an option in a menu or the entry of a character in a message.

The substrate 200 can be made of any material that is suitable for supporting circuitry, such as signal traces or paths. For example, the substrate 200 can be a flexible printed circuit that can be positioned in the housing 105 of the mobile device 100. The substrate 200 can include one or more edges 210, which can define a perimeter of the substrate 200. At least some of the dome pads 205 can be outer dome pads 215 that can be located along an edge 210 of the substrate 200. These outer dome pads 215 can help form outer domes (not shown) that also can be located along an edge 210 of the substrate. As noted earlier, these outer domes may be more susceptible to external contaminants than domes that are closer to the center of the substrate 200.

Figure 3:
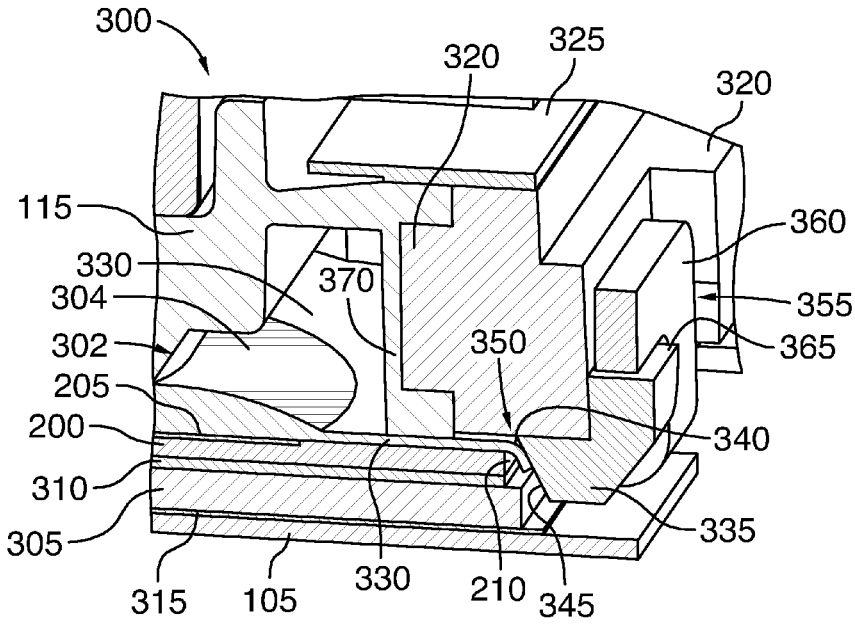
FIG. 3 illustrates a cross-section of an exemplary keypad assembly.

Referring to FIG. 3, a cross-section of a portion of a keypad assembly 300 of the mobile device 100 of FIG. 1 is shown. The keypad assembly 300 can include the substrate 200 of FIG. 2, on which a plurality of domes 302 may be positioned. Each dome 302 can include a corresponding dome pad 205 (see also FIG. 2) and a corresponding dome cover 304 in which the dome cover 304 is positioned substantially over the dome pad 205. The dome cover 304 can be a compressible structure and can contact the dome pad 205 when the dome cover 304 is forced down, thereby completing a circuit and causing a corresponding action in the mobile device 100 to occur. When the force is removed, the dome cover 304 can return substantially to its original state.

In one arrangement, the assembly 300 can also include a stiffener 305, which can provide support to the substrate 200, particularly if the substrate is a flexible printed circuit. As an example, the stiffener 305 can be made of metal, although other suitable materials may be considered. To help secure substrate 200 to the stiffener 305, a conductive adhesive 310 can be applied between these components. The conductive adhesive 310 can also be useful for grounding purposes. The keypad assembly 300 can be assembled into the mobile device 100, and another adhesive 315 can be used to secure the stiffener 305 to the housing 105.

The keypad assembly 300 can also include a light guide 320 that directs light in the assembly 300. A cross-section of the keypad 115 is also shown in FIG. 3, and the keypad 115 can be coupled to the light guide 320. In one arrangement, the keypad 115 can be made of a flexible material, such as rubber or plastic. If the keypad 115 is made of rubber, then the keypad 115 can be co-molded to the light guide 320. As another example, if the keypad 115 is made of plastic, the keypad 115 can be insert molded with the light guide 320 or generated through a two-shot injection molding process. In another arrangement, a film 325 can be positioned over at least a portion of the keypad 115 and the light guide 320 to prevent an unintended emission of light from the keypad assembly 300.

To create a sealed environment for the domes 302 and the substrate 200, a dome overlay 330 can be positioned over the domes 302 and the substrate 200. As an example, the dome overlay 330 can be a film made up of plastic and can include an adhesive (not shown) to help secure the dome overlay 330 to the domes 302 and the substrate 200. As such, the dome overlay 330 can protect these components from external contaminants. The term "dome overlay" is defined as a protective layer that is capable of covering a substrate and components positioned on the substrate and protecting them from contaminants. In one particular implementation, the dome covers 304 can be part of the dome overlay 330, and when the dome overlay 330 is secured to the substrate 200, the dome covers 304 can be positioned over and in mechanical communication with the dome pads 205. In this example, an adhesive (not shown) can secure the tops of the dome covers 304 to the dome overlay 330 prior to the dome overlay 330 being adhered to the substrate 200.

To assist in the creation of the sealed environment, the keypad assembly 300 can include one or more interlocking components 335. The interlocking component 335 can be positioned at an edge 210 of the substrate 200 and can compress the dome overlay 330 at a point of contact 340 of the substrate 200. For example, the interlocking component 335 can compress the dome overlay 330 by bending the dome overlay 330 at the edge 210 of the substrate 200. In one embodiment, the interlocking component 335 can include a beveled surface 345 that can contact and bend the dome overlay 330 at the point of contact 340. To ensure this engagement, the dome overlay 330 can extend beyond the edge 210 of the substrate 200. This engagement between the interlocking component 335 and the dome overlay 330 can minimize the chances that the sealed environment created by the dome overlay 330 will be breached. The term "interlocking component" is defined as a mechanism that engages and at least assists in the securing of a protective layer to a substrate.

In one arrangement, the interlocking component 335 can be made of a deformable material, such as rubber or a soft plastic, and can be attached or coupled to the light guide 320. As an example, the interlocking component 335 can be co-molded to the light guide 320 or produced through a two-shot injection molding step. It is understood, however, that the interlocking component 335 can be made of other suitable materials and may be coupled to the light guide 320 through other measures. Moreover, the interlocking component 335 can even be an integral part of the light guide 320, if so desired.

The interlocking component 335 can be positioned at a dome location 350 along the edge 210 of the substrate 200. Specifically, the interlocking component 335 can be substantially aligned in the same plane as a dome 302 located near or adjacent to the edge 210 of the substrate 200. As a more specific example, a center point of the dome 302 can be substantially parallel or horizontal with a center point of the interlocking component 335. This alignment can ensure that the interlocking components 335 are positioned closest to the domes 302, particularly those near the edges 210 of the substrate 200. Being positioned closer to the domes 302 can improve the sealing function of the interlocking component 335.

In another arrangement, the stiffener 305 can include an engaging structure 355 that can engage the interlocking component 335 for maintaining the interlocking component 335 in position. For example, the engaging structure 355 can be a hook-shaped extension 360 in which one end can be attached to the stiffener 305 and the other end can be positioned over a surface 365 of the interlocking component 335. Focusing on the end positioned over the surface 365, in one implementation, the engaging structure 355 can contact surface 365 of the interlocking component 335, thereby helping the interlocking component 335 compress the dome overlay 330. This engagement can also provide support to help combat the consequences of an accidental drop of the mobile device 100 (see FIG. 1). Alternatively, the engaging structure 355 can be positioned just above the surface 365 of the interlocking component 335 so that the engaging structure 355 does not directly contact the interlocking component 335 during normal conditions. When the impact from a drop is experienced, however, the engaging structure 355 could contact the interlocking component 335, thereby minimizing the effect of the drop.

To further the seal provided by the dome overlay 330, the keypad 115 can include one or more compression legs 370. The compression leg 370 can contact the dome overlay 330 and provide a compression force when the keypad 115 is built into the keypad assembly 300. As another option, one or more stiffeners (not shown), such as a small rod or plate, can be attached to the compression leg 370 to provide the leg 370 with greater structural stability.

Figure 4:
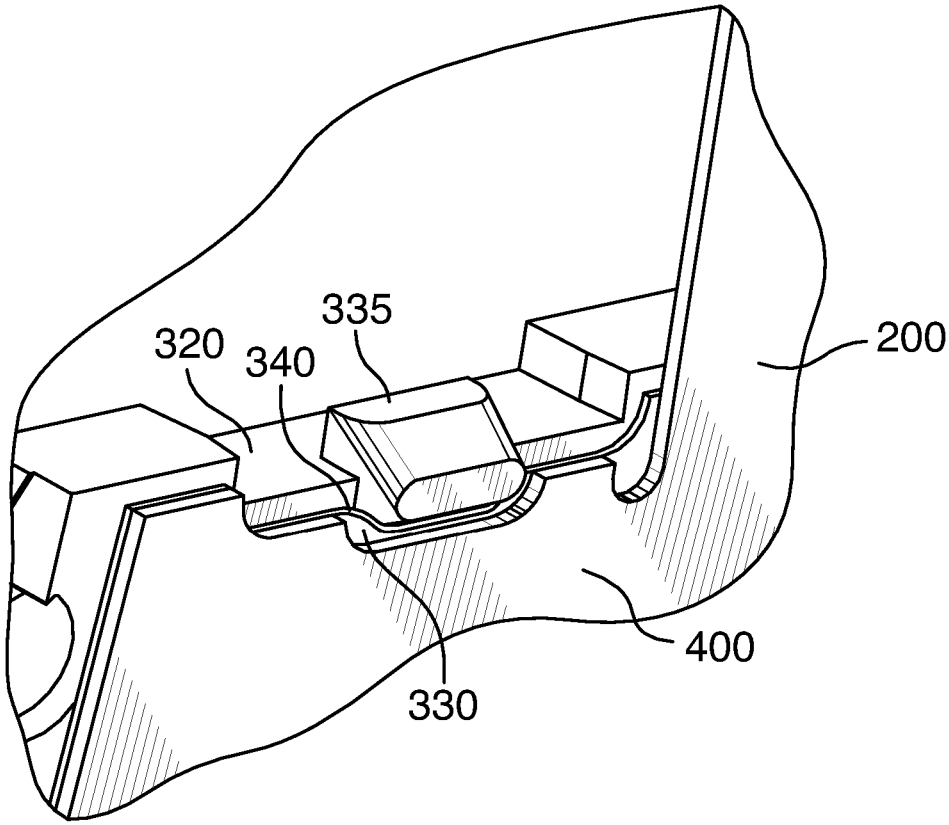
FIG. 4 illustrates another view of the keypad assembly of FIG. 3.

Referring to FIG. 4, the interlocking component 335 is shown from a different angle, in comparison to that of FIG. 3. This view shows a surface 400 of the substrate 200 that does not include the domes 302. Here, similar to FIG. 3, the interlocking component 335 can be attached to the light guide 320, and the dome overlay 330 can extend beyond the substrate 200. As can be seen, the interlocking component 335 can compress the dome overlay 330 at the point of contact 340.

Figure 5:
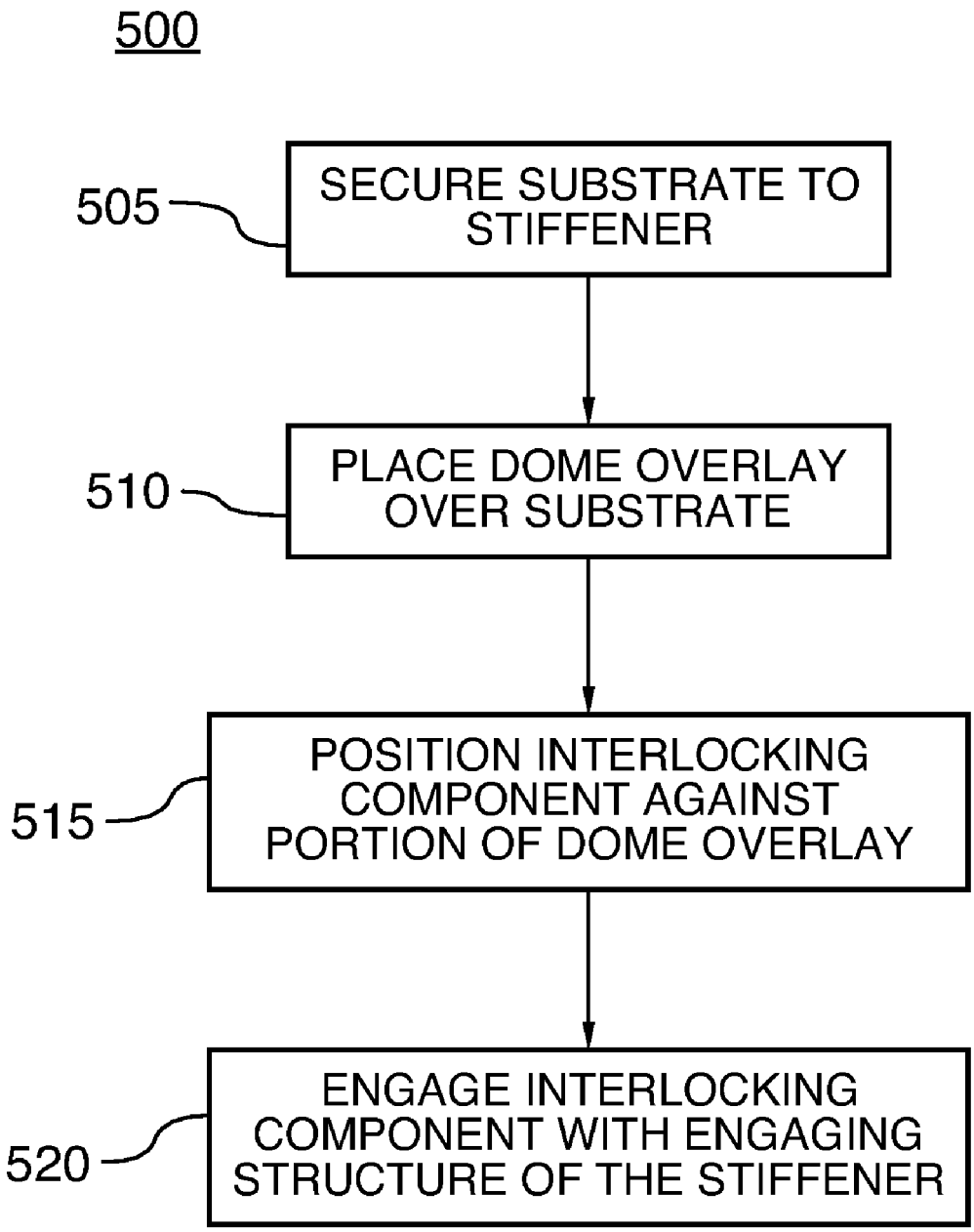
FIG. 5 illustrates an exemplary method of assembling a keypad assembly.

Referring to FIG. 5, a method 500 of assembling a keypad assembly is shown. To describe this method, reference may be made to the components of FIGS. 1-4, although the method can be applicable to or practiced with other structures. Moreover, the steps of the method 500 are not limited to the order in which they are presented here, and the method 500 may include a greater (or even fewer) number of steps than what is shown.

At step 505, the substrate 200 having a plurality of dome pads 205 can be secured to the stiffener 305. At step 510, the dome overlay 330—including the dome covers 304—can be placed over the substrate 200 such that a portion of the dome overlay 330 extends beyond the edge 210 of the substrate 200. The dome covers 304 and the dome pads 205 can form the domes 302. At step 515, the interlocking component 335 can be positioned against a portion of the dome overlay 330 extending beyond the edge 210 of the substrate 200 such that the interlocking component 335 compresses the portion of the dome overlay 330. This process can assist in the creation of a sealed environment for the domes 302. At step 520, the interlocking component 335 can be engaged with the engaging structure 355 of the stiffener 305 to maintain the interlocking component 335 in position to compress the portion of the dome overlay 330.

Figure 6:
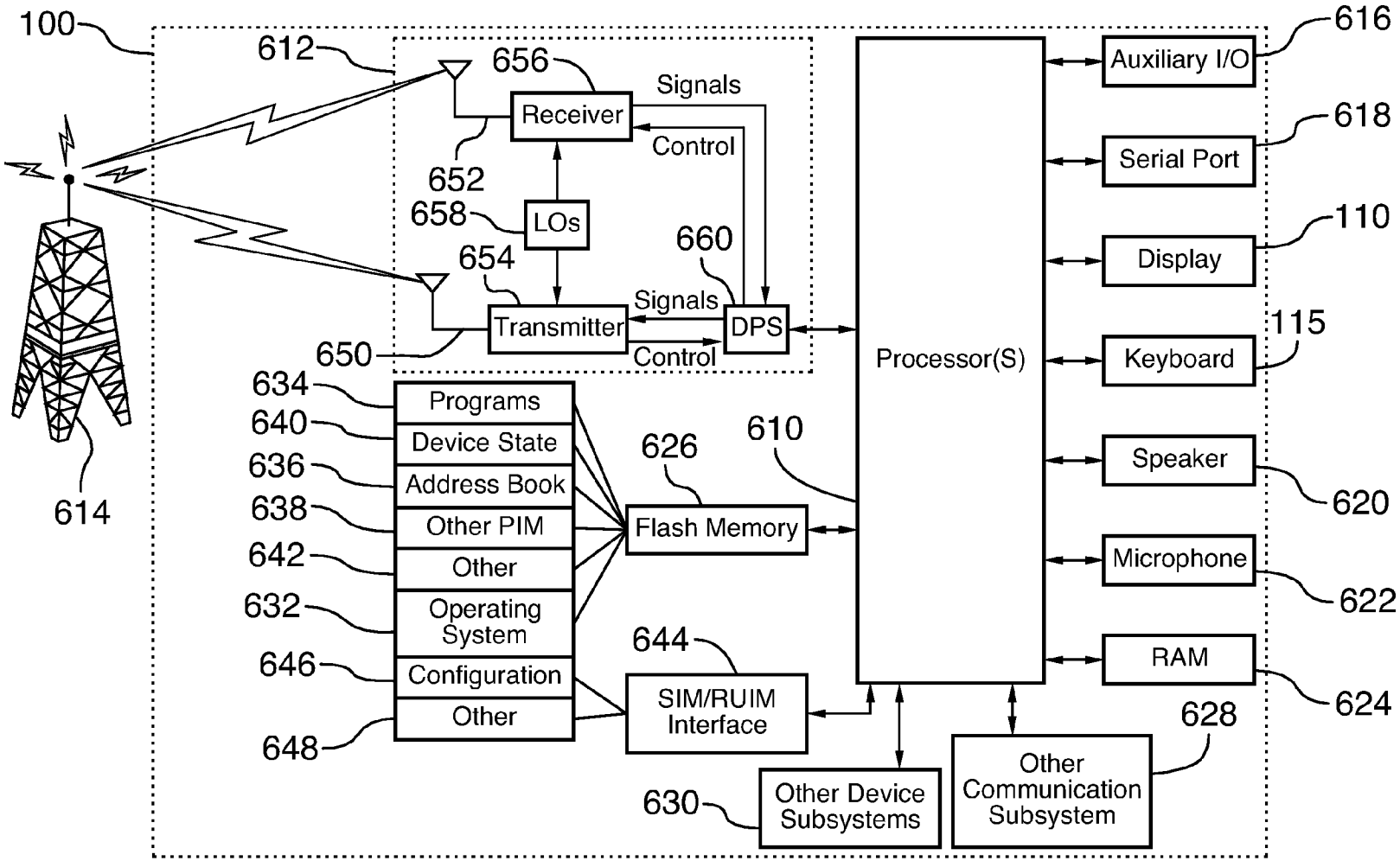
FIG. 6 illustrates an example of a block diagram of several exemplary components that can be part of the mobile device of FIG. 1.

Referring to FIG. 6, an example of a block diagram of some of the components that can be part of the mobile device 100 is shown. The mobile device 100 can include a processor 610 that can control the operation of the mobile device 100. A communication subsystem 612 can perform all communication transmission and reception with a wireless network 614. The processor 610 can further be coupled to an auxiliary input/output (I/O) subsystem 616, which can be coupled to the mobile device 100. In at least one embodiment, the processor 610 can be coupled to a serial port (for example, a Universal Serial Bus port) 618, which can allow for communication with other devices or systems. The display 110 can be coupled to the processor 610 to allow for displaying of information to an operator of the mobile device 100. The keypad 115 can also be coupled to the processor 610.

The mobile device 100 can include a speaker 620, a microphone 622, random access memory (RAM) 624 and flash memory 626, all of which can be coupled to the processor 610. Other similar components can be provided on the mobile device 100 and optionally coupled to the processor 610. Other communication subsystems 628 and other communication device subsystems 630 are generally indicated as being functionally coupled with the processor 610, as well. An example of a communication subsystem 628 is that of a short range communication system such as BLUETOOTH® communication module or a WI-FI® communication module (a communication module in compliance with IEEE 802.11 set of protocols) and associated circuits and components.

The processor 610 is able to perform operating system functions and can enable execution of programs on the mobile device 100. In some embodiments, not all of the above components may be included in the mobile device 100. For example, in at least one embodiment, the keypad 115 is not provided as a separate component and is displayed as required on a dynamic touch display (not shown). In an embodiment having a dynamic touch display, the keypad 115 can be displayed as a touchscreen keypad (not shown). A touchscreen module can be incorporated in such an embodiment such that it is in communication with the processor 610. When inputs are received on the touchscreen keypad, the touchscreen module can send or relay messages corresponding to those inputs to the processor 610.

The auxiliary I/O subsystem 616 can take the form of a navigation tool, such as an optical trackpad, a thumbwheel, a mechanical trackball, a joystick, a touch-sensitive interface, or some other I/O interface. Other auxiliary I/O subsystems can include external display devices and externally connected keyboards (not shown). While the above examples have been provided in relation to the auxiliary I/O subsystem 616, other subsystems capable of providing input or receiving output from the mobile device 100 are considered within the scope of this disclosure. Other keys or buttons can be placed along the side of the mobile device 100 to function as escape keys, volume control keys, scrolling keys, power switches, or user programmable keys, and can likewise be programmed accordingly.

Furthermore, the mobile device 100 can be equipped with components to enable operation of various programs, as shown in FIG. 6. In an exemplary embodiment, the flash memory 626 can be enabled to provide a storage location for an operating system 632, device programs 634 and data. The operating system 632 can generally be configured to manage other programs 634 that are also stored in flash memory 626 and executable on the processor 610. The operating system 632 can honor requests for services made by programs 634 through predefined program 634 interfaces. More specifically, the operating system 632 can typically determine the order in which multiple programs 634 are executed on the processor 610 and the execution time allotted for each program 634, manage the sharing of flash memory 626 among multiple programs 634, handle input and output to and from other device subsystems 630, and so on. In addition, operators can typically interact directly with the operating system 632 through a user interface, which can include the display 110 and the keypad 115. While in an exemplary embodiment, the operating system 632 is stored in flash memory 626, the operating system 632 in other embodiments is stored in read-only memory (ROM) or a similar storage element (not shown). As those skilled in the art will appreciate, the operating system 632, the device program 634 or parts thereof can be loaded in RAM 624 or some other volatile memory.

In one exemplary embodiment, the flash memory 626 can contain programs 634 for execution on the mobile device 100 including an address book 636, a personal information manager (PIM) 638 and the device state 640. Furthermore, programs 634 and other information 642 including data can be segregated upon storage in the flash memory 626 of the mobile device 100.

When the mobile device 100 is enabled for two-way communication within the wireless communication network 614, it can send and receive messages from a mobile communication service. Examples of communication systems enabled for two-way communication can include, but are not limited to, the General Packet Radio Service (GPRS) network, the Universal Mobile Telecommunication Service (UMTS) network, the Enhanced Data for Global Evolution (EDGE) network, the Code Division Multiple Access (CDMA) network, High-Speed Packet Access (HSPA) networks, Universal Mobile Telecommunication Service Time Division Duplexing (UMTS-TDD), Ultra Mobile Broadband (UMB) networks, Worldwide Interoperability for Microwave Access (WiMAX) networks, Long Term Evolution (LTE) networks and other networks that can be used for data and voice, or just data or voice.

For the systems listed above, the mobile device 100 can require a unique identifier to enable the mobile device 100 to transmit and receive messages from the communication network 614. Other systems may not require such identifying information. As an example, GPRS, UMTS, and EDGE use a Subscriber Identity Module (SIM) in order to allow communication with the communication network 614. Likewise, most CDMA systems use a Removable User Identity Module (RUIM) to communicate with the CDMA network. The RUIM and SIM card can be used in multiple different mobile devices 100. The mobile device 100 can be able to operate some features without a SIM/RUIM card. A SIM/RUIM interface 644 located within the mobile device 100 can allow for removal or insertion of a SIM/RUIM card (not shown). The SIM/RUIM card can feature memory and can hold key configurations 646, and other information 648, such as identification and subscriber related information. With a properly enabled mobile device 100, two-way communication between the mobile device 100 and communication network 614 is possible.

The two-way communication enabled mobile device 100 can both transmit and receive information from the communication network 614. The transfer of communication can be from the mobile device 100 or to the mobile device 100. To communicate with the communication network 614, the mobile device 100 in the presently described exemplary embodiment is equipped with an integral or internal antenna 650 for transmitting messages to the communication network 614. Likewise, the mobile device 100 in the presently described exemplary embodiment can be equipped with another antenna 652 for receiving communication from the communication network 614. These antennae (650, 652), in another exemplary embodiment, can be combined into a single antenna (not shown). As one skilled in the art would appreciate, the antenna or antennae (650, 652) in another embodiment can be externally mounted on the mobile device 100. The mobile device 100 can also have a transmitter 654 and a receiver 656, which can be respectively coupled to antennae (650, 652), and can also include one or more local oscillators 658 for processing the incoming or outgoing RF signals. The mobile device 100 can also have a digital signal processor (DSP) 660 to assist in the processing of the incoming and outgoing signals.

Portions of the mobile device 100 and supporting components can take the form of hardware elements, software elements or elements containing both hardware and software. In one embodiment, the software portions can include, but are not limited to, firmware, resident software, microcode, etc. Furthermore, these software portions can take the form of a computer program product accessible from a computer-usable or computer-readable medium providing program code for use by or in connection with a computer or any instruction execution system. For the purposes of this description, a computer-usable or computer readable medium can be any apparatus that can contain, store, communicate, propagate, or transport the program for use by or in connection with the instruction execution system, apparatus, or device. The medium can be an electronic, magnetic, optical, electromagnetic, infrared, or semiconductor system (or apparatus or device) or a propagation medium (though propagation mediums in and of themselves as signal carriers are not included in the definition of physical computer-readable medium). Examples of a physical computer-readable medium include a semiconductor or solid state memory, magnetic tape, a removable computer diskette, a random access memory (RAM), a read-only memory (ROM), a rigid magnetic disk and an optical disk. Current examples of optical disks include compact disk-read only memory (CD-ROM), compact disk-read/write (CD-R/W) and DVD. Both processors and program code for implementing each as aspect of the system can be centralized or distributed (or a combination thereof) as known to those skilled in the art.

A data processing system suitable for storing program code and for executing program code, which can be implemented in any of the above-referenced devices described herein, can include at least one processor coupled directly or indirectly to memory elements through a system bus. The memory elements can include local memory employed during actual execution of the program code, bulk storage, and cache memories that provide temporary storage of at least some program code in order to reduce the number of times code must be retrieved from bulk storage during execution. I/O devices (including but not limited to keyboards, displays, pointing devices, etc.) can be coupled to the system either directly or through intervening I/O controllers.

Examples have been described above regarding a keypad assembly and method of assembly of same. Various modifications to and departures from the disclosed embodiments will occur to those having skill in the art. The subject matter that is intended to be within the spirit of this disclosure is set forth in the following claims.

What is claimed is:

1. A keypad assembly, comprising:

a substrate;

a plurality of domes positioned on the substrate and configured to translate operator action into a corresponding input for a machine;

a dome overlay positioned over the domes and the substrate, wherein the dome overlay creates a sealed environment for the substrate and the domes; and an interlocking component that compresses the dome overlay by bending the dome overlay at an edge of the substrate to assist in the creation of the sealed environment.

2. The keypad assembly according to claim 1, wherein the substrate is a flexible printed circuit and the keypad assembly further comprises a stiffener providing support for the flexible printed circuit.

3. The keypad assembly according to claim 2, wherein the stiffener includes an engaging structure that engages the interlocking component for maintaining the interlocking component in position.

4. The keypad assembly according to claim 3, wherein the engaging structure is a hook-shaped extension positioned over a surface of the interlocking component.

5. The keypad assembly according to claim 2, further comprising a conductive adhesive that secures the flexible printed circuit to the stiffener.

6. The keypad assembly according to claim 1, further comprising a keypad positioned over the dome overlay, wherein the keypad includes a compression leg that engages the dome overlay.

7. The keypad assembly according to claim 1, wherein the interlocking component includes a beveled surface that contacts the dome overlay to enable the interlocking component to compress the dome overlay.

8. The keypad assembly according to claim 6, further comprising a light guide that directs light in the keypad assembly and wherein the interlocking component is coupled to the light guide.

9. The keypad assembly according to claim 1, wherein the interlocking component is made of a deformable material.

10. The keypad assembly according to claim 1, wherein the interlocking component is positioned at a dome location along an edge of the substrate.

11. A keypad assembly, comprising:

a substrate;

a plurality of domes positioned on the substrate and configured to translate operator action into a corresponding input for a mobile device, wherein at least some of the domes are outer domes that are located along an edge of the substrate;

a dome overlay positioned over the domes and the substrate to prevent external contaminants from affecting the domes; and an interlocking component positioned at the edge of the substrate for selectively compressing the dome overlay by bending the dome overlay at an edge of the substrate.

12. The keypad assembly according to claim 11, further comprising a light guide, wherein the interlocking component is attached to the light guide.

13. The keypad assembly according to claim 11, wherein the interlocking component includes a beveled surface with respect to the substrate and the beveled surface compresses the dome overlay by bending the dome overlay at a point of contact of the substrate.

14. The keypad assembly according to claim 11, wherein the substrate is a flexible printed circuit and the keypad assembly further comprises a stiffener providing support for the flexible printed circuit.

15. The keypad assembly according to claim 14, wherein the stiffener includes an engaging structure that engages a surface of the interlocking component to maintain the interlocking component in position.

16. The keypad assembly according to claim 11, further comprising a keypad having a plurality of keys positioned over the domes, wherein the domes collapse when an operator presses down on the keys.

17. The keypad assembly according to claim 11, wherein the interlocking component is positioned at a dome location along the edge of the substrate.

18. A method of assembling a keypad assembly, comprising:

securing a substrate having a plurality of dome pads to a stiffener;

placing a dome overlay over the substrate such that a portion of the dome overlay extends beyond an edge of the substrate; and positioning an interlocking component against a portion of the dome overlay extending beyond the edge of the substrate such that the interlocking component compresses the portion of the dome overlay to assist in the creation of a sealed environment for a plurality of domes.

19. The method according to claim 18, further comprising engaging the interlocking component with an engaging structure of the stiffener to maintain the interlocking component in position to compress the portion of the dome overlay.

* * * * *